US005570954A

United States Patent [19]

Sukup

[11] Patent Number: 5,570,954

[45] Date of Patent: Nov. 5, 1996

[54] CARRIAGE RETURN APPARATUS FOR A GRAIN STIRRING DEVICE HAVING MULTIPLE STIRRERS

[75] Inventor: Eugene G. Sukup, Hampton, Iowa

[73] Assignee: Sukup Manufacturing Company, Sheffield, Iowa

[21] Appl. No.: 396,545

[22] Filed: Mar. 1, 1995

[51] Int. Cl.[6] ..... B01F 7/24

[52] U.S. Cl. ..... 366/261

[58] Field of Search ..... 366/64–66, 261, 366/281–284, 288, 297, 299, 300, 318, 603

[56] References Cited

U.S. PATENT DOCUMENTS

| | | | |
|---|---|---|---|
| 3,584,842 | 6/1971 | Sukup | 366/261 |
| 3,592,447 | 7/1971 | Steffen | 366/261 X |
| 3,776,512 | 12/1973 | McKinnon | 366/261 |
| 4,162,857 | 7/1979 | Spurling | 366/261 |
| 4,248,538 | 2/1981 | Sukup | 366/261 |
| 4,274,750 | 6/1981 | Smit | 366/261 |
| 4,322,171 | 3/1982 | Clark | 366/261 |
| 4,836,686 | 6/1989 | Sukup . | |
| 4,854,719 | 8/1989 | Sukup . | |

*Primary Examiner*—Charles E. Cooley
*Attorney, Agent, or Firm*—Zarley, McKee, Thomte, Voorhees & Sease

[57] ABSTRACT

A carriage return apparatus for reciprocable longitudinal movement along a shaft that traverses a support rail of a grain stirring device mounted on a grain bin. The carriage return includes a primary carrier and a satellite carrier movably mounted on the shaft between first and second longitudinally spaced engagement plates protruding radially therefrom and a reversing rod assembly coupling the carriers together for movement in unison between the plates on the shaft. The primary carrier has a pivotally mounted drive bearing for frictionally engaging the shaft and moving both carriers therealong. The length of the reversing rod assembly can be selected so as to optimize the stirring coverage in the grain bin.

15 Claims, 3 Drawing Sheets

10
12
14
16
18
20
22
24
25
26
28
30
32
34
36
38
54
56
66
68
70
74
76
3
M

CARRIAGE RETURN APPARATUS FOR A GRAIN STIRRING DEVICE HAVING MULTIPLE STIRRERS

BACKGROUND OF THE INVENTION

This invention relates to grain stirring devices and more particularly to a carriage return apparatus for coordinated reciprocal movement of multiple stirrers along the shaft of a grain stirring device to improve stirring coverage and therefore drying of the grain. The apparatus of this invention effectively eliminates the unstirred regions left between a plurality of adjacent stirrers.

Various known devices exist for stirring grain. U.S. Pat. No. 4,854,719, which issued Aug. 8, 1989, discloses a grain stirring device having a single, powered, auger-like stirrer supported on a carrier that is reciprocally movable longitudinally along a rotating shaft. The shaft is supported on one or more rails and moves in a direction generally transverse to the movement of the carrier when the shaft is rotated. A drive bearing or roller on the carrier frictionally engages the shaft. The roller is supported on a support member mounted on the carrier and is adaptable for shiftable pivotal movement about a fixed shift axis between two positions.

In one position, the roller is pivoted so its axis of rotation is at a positive angle with respect to the longitudinal axis of the shaft. When the shaft rotates, the roller rolls a helical path thereon, which causes the carrier to advance longitudinally in one direction. In another position, the roller is pivoted so its axis of rotation is at a negative angle with respect to the longitudinal axis of the shaft. The helical path and carrier advances longitudinally in the other direction. This basic device can be applied to grain bins of various shapes, including rectangular and circular.

A plurality of stirrers, mounted on respective carriers, can be made to operate on one shaft by interposing circular plates between them as disclosed in U.S. Pat. No. 4,836,686, which issued Jun. 6, 1989. However, a region of unstirred grain results below the circular plate interposed between the adjacent stirrers.

Therefore, a primary object of this invention is the provision of a carriage return apparatus for a grain stirring device that eliminates unstirred regions between adjacent stirrers.

A further object of the present invention is the provision of a carriage return apparatus for a grain stirring device that improves the stirring coverage obtained in a grain bin.

A further object of the present invention is the provision of a carriage return apparatus that allows the travel of adjacent stirrers along the shaft to be overlapped so as to improve stirring coverage.

A further object of the present invention is the provision of a grain stirring apparatus which is durable and reliable in use, and is economical to manufacture.

This invention contemplates other objects, features and advantages which will become more fully apparent from the following detailed description taken in conjunction with the accompanying drawings.

SUMMARY OF THE INVENTION

Figures 1, 2:
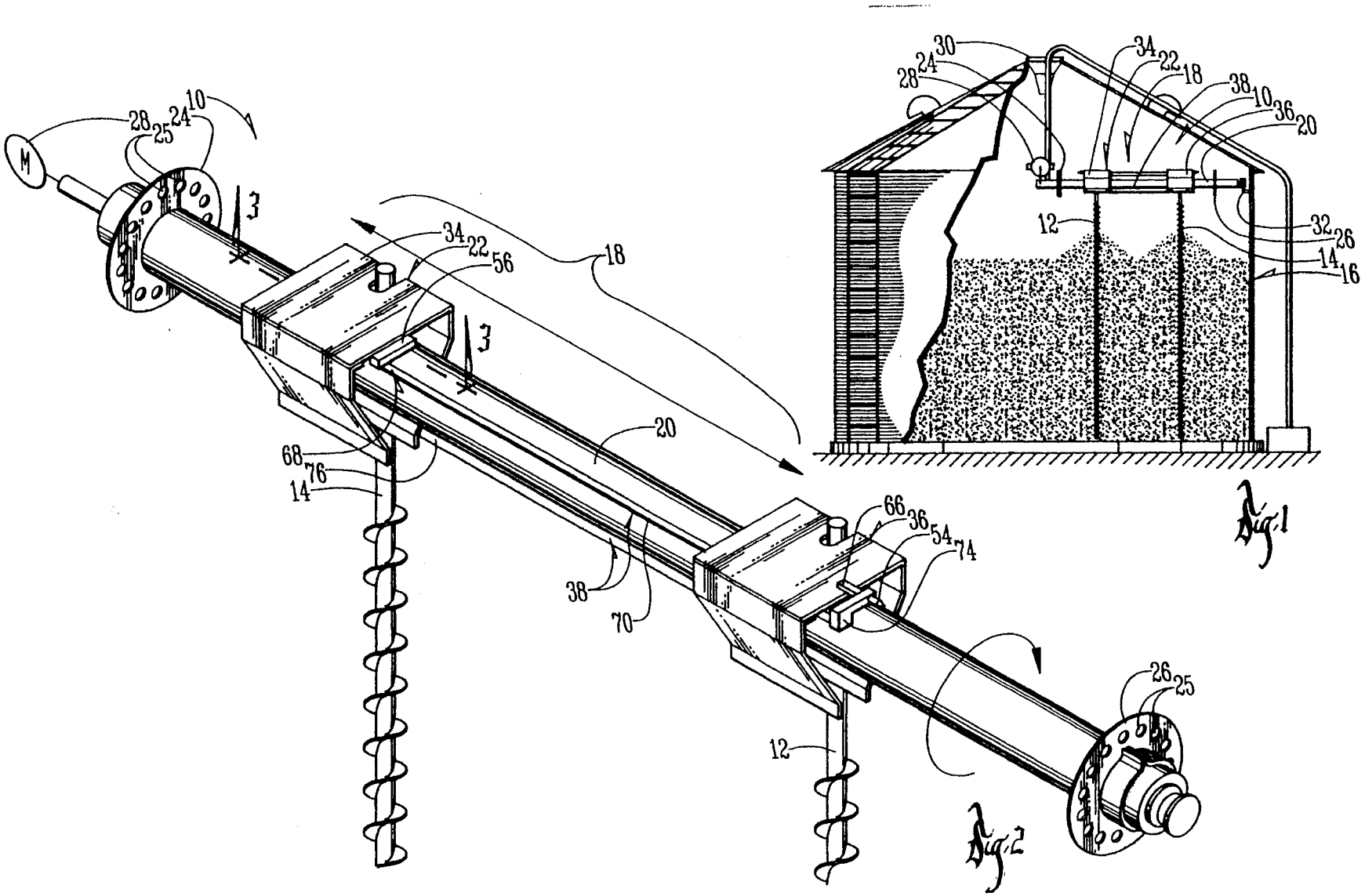
FIG. 1 is a perspective view of a circular grain bin, which has been partially cut away to show a grain stirring device equipped with the carriage return of the present invention.
FIG. 2 is a combination figure schematically showing a motor attached to the shaft and perspectively showing the shaft equipped with the carriage return of the present invention.

The present invention provides a carriage return apparatus for reciprocable longitudinal movement along a shaft mounted on a support rail in a grain bin. A plurality of carriers are mounted and interconnected on a shaft so as to improve the stirring coverage in a grain bin. The carriage return of this invention includes a primary carrier movably mounted on the shaft adjacent the first engagement plate and having a stirring means mounted thereon directed downwardly into the grain in the grain bin. This carrier affects stirring in a first zone of the grain. A drive bearing or roller is pivotally mounted on the primary carrier so as to frictionally engage the shaft and move the primary carrier longitudinally along the shaft. Gear means are pivotally attached to the primary carrier and secured to the drive bearing for pivoting the same. A stop pin is connected to the gear means and pivotally mounted to the primary carrier so as to protrude therefrom and strike the first engagement plate when the primary carrier reaches the first limit position.

A satellite carrier is movably mounted on the shaft adjacent the second engagement plate and adjacent the primary carrier. The satellite carrier has stirring means mounted thereon directed downwardly into the grain in the grain bin to stir grain in a second zone. A plurality of ball roller assemblies are mounted on the satellite carrier for engaging the shaft and allowing the satellite carrier to move longitudinally along the shaft. A stop pin is pivotally mounted to protrude from the satellite carrier so as to strike the second engagement plate when the secondary carrier reaches the second limit position.

A reversing rod assembly couples the stop pin of the satellite carrier and the gear means of the primary carrier so that the drive bearing always pivots when the satellite carrier reaches the second limit position. Thus, the satellite carrier moves and changes direction in unison with the primary carrier. Both carriers reciprocate longitudinally together along the shaft between the first limit position and the second limit position when the shaft is rotated.

The reversing rod assembly can be provided with an adjustable length rod. When the adjustable length rod is constructed such that its length is less than one-half the length of the shaft between the engagement plates, the first and second zones of stirring overlap. Such overlap contributes to the elimination of unstirred regions of grain.

The present invention is useful with grain stirring devices in grain bins of various cross-sections, including grain bins of circular cross-section and grain bins of rectangular cross-section. Multiple satellite carriers can be connected to a single primary carrier according to the teaching of this invention.

DETAILED DESCRIPTION OF THE PREFERRED EMBODIMENT

Reference numeral 10 generally designates a grain stirring device constructed in accordance with the principles of this invention. The device 10, as diagramatically illustrated in FIG. 1, includes two stirrers 12 and 14 which extend downwardly into a grain bin 16 and which are moved in horizontal directions through the grain by a traversing mechanism 18. A continuous strip of flighting winds helically upward on the stirrers 12 and 14 to move the grain upwardly as the stirrers are rotated in one direction by respective stirrer motors (not shown), thus mixing and aerating the grain. The stirrer and its respective motor constitute a stirring means.

In the device illustrated in FIG. 1, the traversing mechanism 18 includes a horizontal shaft 20 which supports a traversing carriage return 22 for reciprocating between the engagement plates 24 and 26 fixed on shaft 20. The engagement plates 24 and 26 are preferably circular and include a centered circular array of holes 25 therethrough, as best seen in FIG. 2.

In FIG. 1, the shaft 20 extends in a generally horizontal direction above the grain in the bin and rotates about its central longitudinal axis by a source of rotary power, such as an electric motor 28. In the case of a bin 16 that is round (like illustrated in FIG. 1), the motor 28 is suspended from the apex of the bin roof and electrical power is supplied through a central opening 30 in the grain bin 16. Opposite the connection with the motor 28, the other end of shaft 20 is supported for rolling movement by a support rail 32 mounted to the inner periphery of the grain bin 16. Thus, the support rail provides a circular track along which the outer end of the shaft 20 rolls in an arc around the periphery of the bin 16.

As shown in FIG. 2, carriers 34 and 36 support and journal the stirrers 12 and 14, respectively. A conventional electric stirrer motor (not shown) is also mounted to each carrier to drive the corresponding stirrer about its vertical axis. Carrier 34 acts as the primary carrier, whereas carrier 36 acts as a satellite carrier. Carrier 36 is referred to as a satellite carrier because it follows the movements of the primary carrier 34 along the shaft 20, especially directional changes, due to connecting means 38 attached to the carriers 34 and 36.

Figure 3:
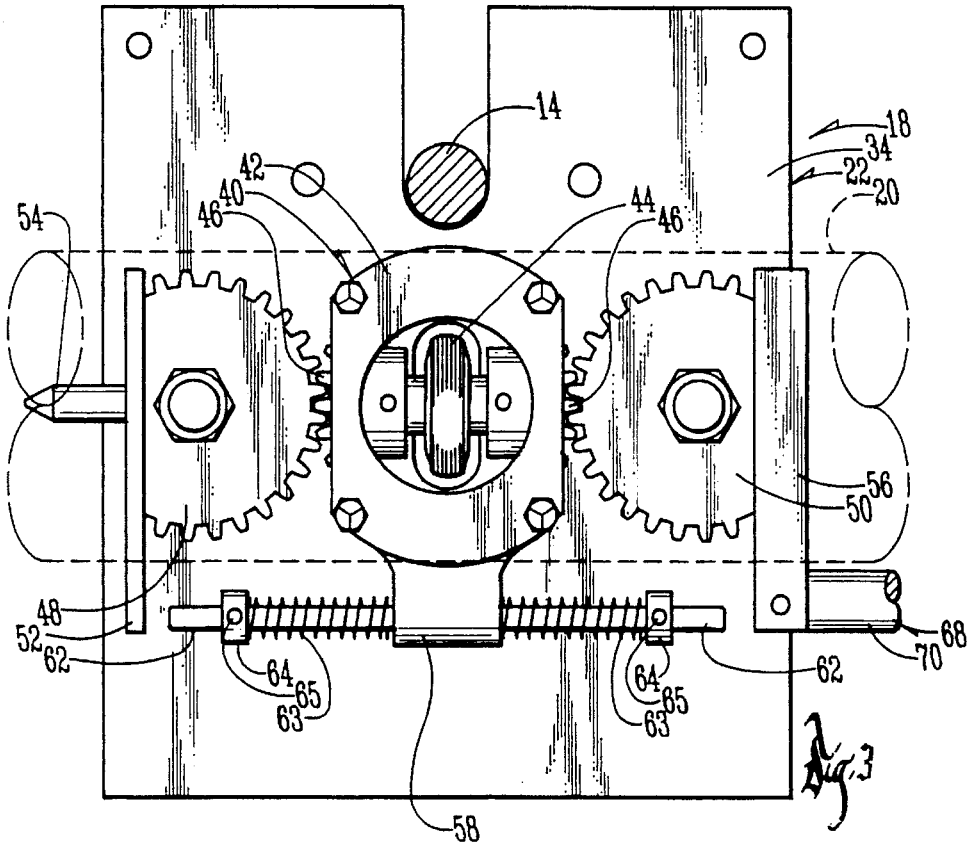
FIG. 3 is a bottom plan view of the upper portion of the primary carrier of the present invention, taken along line 3—3 of FIG. 2 showing the direction changing mechanism and shiftable pivotal support roller or drive bearing.

As seen in FIG. 3, the primary carrier 34 is equipped with a roller assembly 40 for frictionally engaging the shaft, as well as supporting the carrier for rolling movement along the shaft 20. Roller assembly 40 includes a support member 42 rigidly secured to the carrier 34 and a drive bearing 44 mounted to pivot with a gear 46. A directional gear 48 and a toggle gear 50 engage and mesh with gear 46. Gears 46, 48, and 50 are preferably arranged along a common axis parallel with the longitudinal axis of the shaft 20.

In the neutral condition shown in FIG. 3, the roller assembly 40 is positioned such that the drive bearing 44 has an axis of rotation that is coplanar with and parallel to the central longitudinal axis of shaft 20. As a result, the carrier 34 remains stationary and will not longitudinally traverse the shaft 20 when the shaft is rotated. This is referred to as a neutral or non-traversing condition. Normally however, frictional forces cause the drive bearing 44 and the attached gear 46 to pivot to a positive or negative angle when the shaft 20 rotates. Two opposite traversing conditions are thereby defined. Because the drive bearing 44 is urged to an angle with respect to the central longitudinal axis of the shaft 20, the carrier 34 advances or traverses longitudinally in one direction or the other along the shaft 20.

As best seen in FIG. 3, directional gear 48 includes a pivot arm 52 fixed to the truncated periphery of directional gear 48 generally opposite the gear 46. Pivot arm 52 extends across the minor diameter of the directional gear 48 in a chordal fashion and an end of the pivot arm 52 protrudes beyond the major diameter of the directional gear 48. A pivot pin 54 is attached to the pivot arm 52 and extends along the common axis shared by gears 46, 48, and 50. Likewise, the toggle gear 50 has a toggle bar 56 fixed to the truncated periphery of gear 50 opposite the gear 46. The toggle bar 56 extends chordally across minor diameter of the toggle gear 50 and protrudes therebeyond by roughly the same amount as the pivot arm 52 does with the directional gear 48.

The roller assembly 40 has an arm 58 extending from the support member 42 and between the protrusions of pivot arm 52 and the toggle bar 56. A stop rod 62 extends through a clearance hole in the roller assembly arm 58 and is parallel to the common axis shared by the gears 46, 48 and 50. The stop rod 62 extends between the protruding portion of the pivot arm 52 and the protruding portion of the toggle bar 56. At each end of the stop rod 62, a spring 63 is mounted over the stop rod 62. The spring 63 is held between the arm 58 and a collar 64 that is fixed against axial movement along the stop rod 62 by a set screw 65. Thus, the stop rod 62, the position of the adjustable collars 64, and the respective springs 63 determine the angle to which the drive bearing 44 can pivot. The angle of the drive bearing is a significant factor in the rate at which the carrier traverses the shaft.

Figure 4:
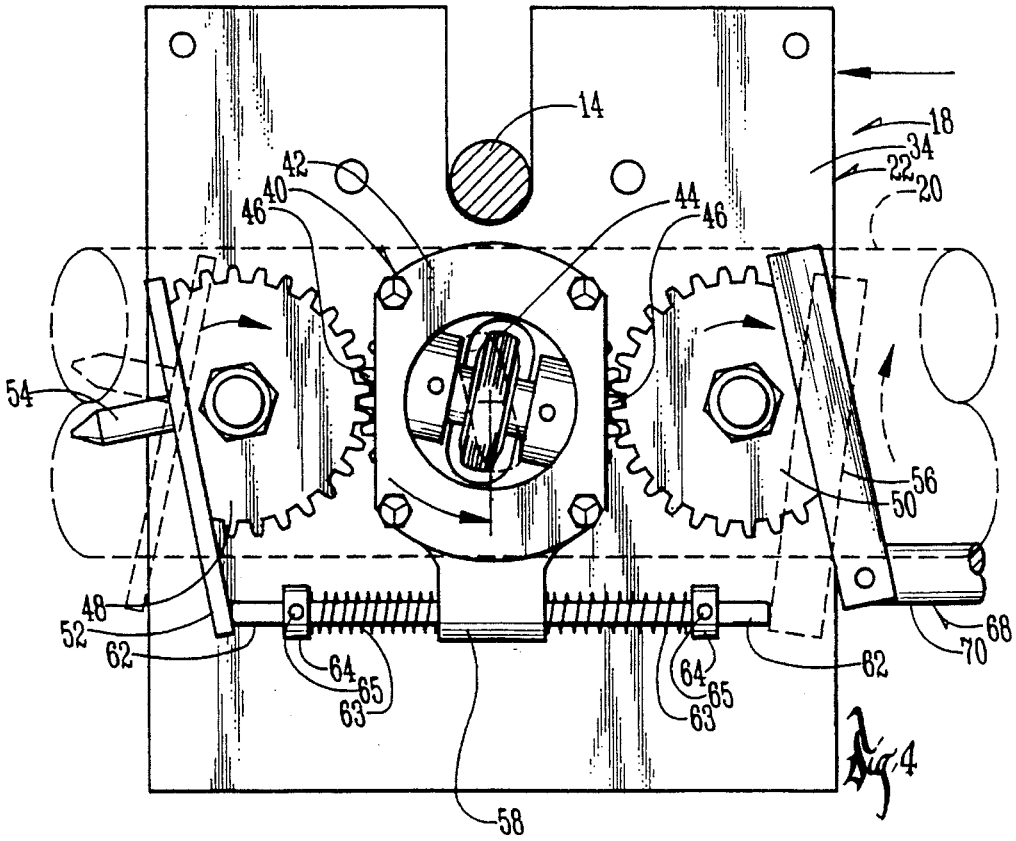
FIG. 4 is similar to FIG. 3, but shows the movement of the direction changing mechanism and roller or drive bearing to affect a new direction of travel.

FIG. 4 illustrates what happens when the pivot pin 54 is forced in the direction shown. The directional gear 48 turns in a clockwise direction and thus pivots gear 46 and drive bearing 44 counterclockwise, which pivots gear 50 clockwise. Therefore, it will be understood that the drive bearing 44 can be pivoted from one direction to another by applying force to the pivot pin 54 in the appropriate direction. Pivoting, or direction changing force, can also be applied by moving the toggle bar 56. The stop rod 62 limits the movement of the pivot arm 52 and the toggle bar 56, respectively by abutment. Normally, frictional forces will keep the drive bearing 44 at the angle determined by the stop rod 62 while the shaft 20 rotates, unless outside forces are applied.

Figure 5:
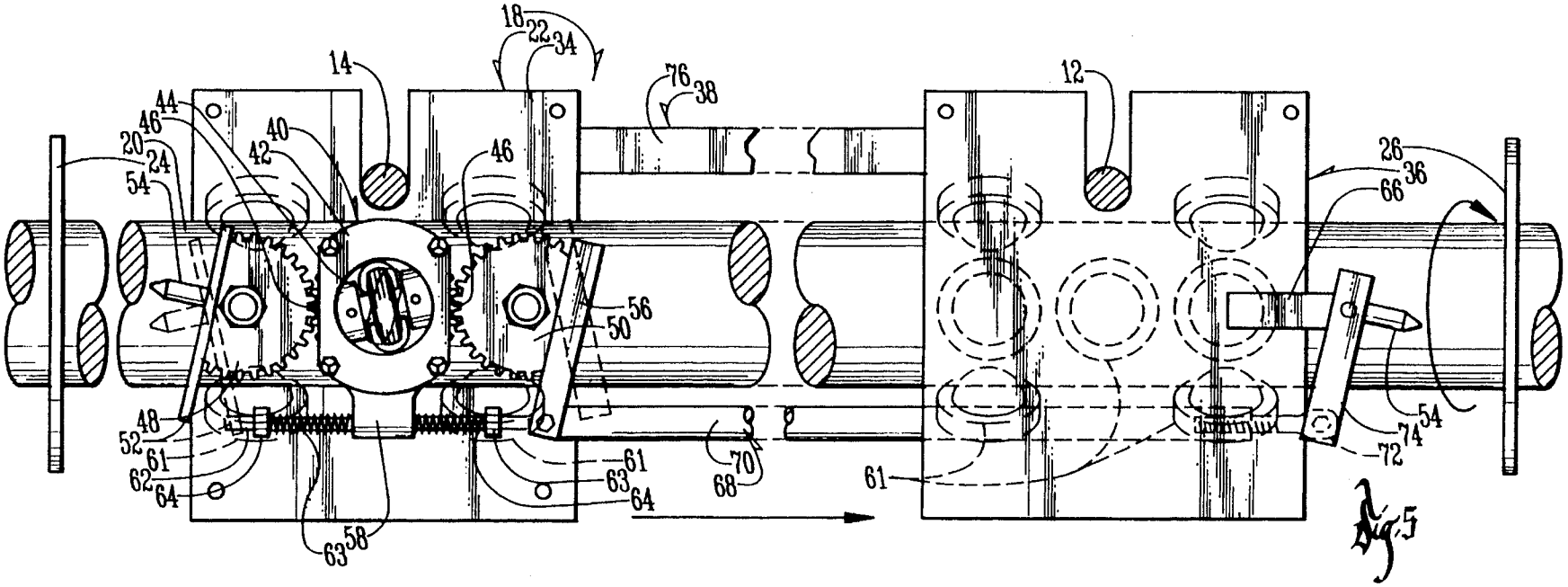
FIG. 5 is top plan view of the carriage return of this invention mounted on the shaft.

As understood from FIG. 5, when the pivot pin 54 of the carrier 34 strikes the engagement plate 24 and engages one of the holes 25, the pivot pin 54 is forced in the direction shown in FIG. 4. This action causes the directional gear 48, drive bearing 44 on gear 46, and toggle gear 50 to pivot as previously described and stop when pivot arm 52 abuts the stop rod 62.

The satellite carrier 36 is generally similar to the primary carrier 34, but does not require gear means, a drive bearing, or a stop rod. Instead, a plurality of ball roller assemblies 61 are mounted on the satellite carrier 36 for supporting it for rolling movement along the shaft 20. Furthermore, the pivot pin 54 is mounted on a toggle arm 74 that is pivotally attached to a strap 66 which is rigidly attached to the satellite carrier 36.

The carrier 36 is made to move and change direction in unison with the primary carrier 34 through a unique connecting means 38 which shall now be described in detail. Coordinated directional changes of the carriers is made practicable by an adjustable reversing means 68 (see FIG. 2). In FIG. 5, the adjustable reversing means 68 includes a rigid reversing rod 70 having one end pivotally connected to the protruding end of the toggle bar 56 of the primary carrier 34 and a second end adjustably, preferably threadably, attached to an extensible hanger bolt 72. The hanger bolt 72 has an eye at one end for pivotal attachment to the toggle arm 74. The opposite end of the toggle arm 74 is pivotally attached to the strap 66 and the pivot pin 54 of the satellite carrier 36 is rigidly attached to the toggle arm 74. Thus, when the pivot pin 54 of the satellite carrier 36 engages the holes 25 of the engagement plate 26, it moves the toggle arm 74 so as to force the hanger bolt 72 and the reversing rod 70 to the right in FIG. 5.

As a result, the rod 70 pulls to the right on the toggle bar 56 of the carrier 34, which pivots gears 46, 48 and 50 to shift the direction of drive bearing 44 in the primary carrier 34. The satellite carrier 36 follows the primary carrier in the new direction of movement. The carriers move and change direction in unison.

Preferably, the drive bearing 44 is set in the neutral position prior to installing the rod 70 between the carriers 34 and 36 so that the toggle bar 56 of the carrier 34 and the toggle arm 74 extend perpendicular to the central longitudinal axis of the shaft 20. Next, the hanger bolt 72 is screwed on the threaded end of the reversing rod 70. The reversing rod 70 is positioned parallel to the shaft 20 and the unthreaded end of rod 70 is pivotally attached to the toggle bar 56 of the primary carrier 34. Then, the hanger bolt 72 is adjusted on the reversing rod 70 so as to align the eye of the hanger bolt with a hole in the end of the toggle arm 74. Finally, the hanger bolt 72 and toggle arm 74 are pinned together with suitable conventional fastening means through the aligned hole and eye.

To provide added rigidity and maintain the desired spacing between the carriers 34 and 36 along the shaft 20, a rigid tie bar 76 is preferably fixed between the carriers 34 and extends generally parallel to the reversing rod 70.

In operation, the shaft 20 is rotated by the motor 28 and traverses the support rail 32 so as to sweep a circular zone above the grain in the round grain bin. The rotation of the shaft 20 also develops frictional forces at the drive bearing 44. The drive bearing 44 moves the carriers 34 and 36 together and in unison along the longitudinal axis of the rotating shaft 20. The stirrer motors are activated and the grain below the carriers is stirred as the shaft 20 traverses the bin and the carriers traverse the shaft.

The longitudinal movement of the traversing carriage return 22, comprising the interconnected primary carrier 34 and satellite carrier 36, continues in one direction until the stop pin 54 of one of the carriers contacts one of the engagement plates 24 or 26, whereupon the adjustable reversing means 68, including the reversing rod 70, ensures that the drive bearing 44 pivots and both carriers change direction and move simultaneously so that the carriage return 22 traverses the shaft in the other direction. The carriage return 22 continues moving in the other direction until the other of the engagement plates 24 or 26 is contacted. In other words, the traversing carriage 22 reciprocates longitudinally between the engagement plates 24 and 26 while the shaft 20 is rotated. Meanwhile, the shaft 20 sweeps a path above the grain. This allows the stirrers 12 and 14 to move in overlapping, multiple direction patterns and provides better stirring coverage of the bin.

It will be understood that the lengths of the tie bar 66 and adjustable reversing means 68 relative to the length of the shaft 20 can be selected so the traversing carriage 22 moves far enough in each direction to ensure complete stirring of the grain below and eliminate any unstirred regions. Preferably, the spacing between the stirrers 12 and 14 is less than one-half the length of the shaft 20 between engagement plates 24 and 26. Such spacing ensures that the paths of the stirrers 12 and 14 will overlap, eliminating unstirred regions of grain between the stirrers. A good way of controlling the spacing between the stirrers 12 and 14 is to control the spacing between their respective carriers 34 and 36. Tie bar 66 serves this purpose well. As long as the length of the tie bar 66 is less than one-half the length of the shaft 20 between the engagement plates 24 and 26, the stirrers will overlap or nearly overlap such that unstirred regions are eliminated. Because effective stirring actually takes place in a cylindrical zone having a central longitudinal axis defined by the rotating stirrer, longer tie bars can be utilized without detracting from this invention. The paths of the stirrers do not have to overlap, so long as the stirred zones do overlap.

Although a circular grain bin has been used to illustrate the present invention, it will be understood that the principles of the present invention are also applicable in a rectangular grain bin. When the present invention is applied in a rectangular grain bin, the shaft 20 is rotated and moved about the bin as described in U.S. Pat. Nos. 4,836,686 and 4,854,719. Said descriptions being incorporated by reference herein. Although the shaft moves rectilinearly along two parallel support rails in a rectangular bin, the carriage return apparatus of this invention can still be utilized since it moves along the length of the shaft itself. When mounted to extend downwardly from the carriers of the carriage return of this invention in a rectangular bin, the stirrers circulate in overlapping rectangular regions or zones, thus eliminating rectangular regions or zones of unstirred grain from between the stirrers.

It will also be understood that the teachings of the present invention can be applied to a primary carrier with multiple satellite carriers connected to the primary carrier for movement in unison back and forth along a shaft.

Whereas the invention has been shown and described in connection with the preferred embodiment thereof, it will be understood that many modifications, substitutions, and additions may be made which are within the intended broad scope of the following claims. From the foregoing, it can be seen that the present invention accomplishes at least all of the stated objectives.

What is claimed is:

1. A carriage return apparatus for reciprocal longitudinal movement along a shaft of a grain stirring device for stirring grain in a grain bin, the shaft having a central longitudinal axis and first and second longitudinally spaced engagement plates protruding radially therefrom to define opposite first and second limit positions, the shaft being mounted generally horizontally for rolling traversing movement along a support rail mounted in the grain bin, the grain stirring device further including a motor for rotating the shaft about the central longitudinal axis whereupon the shaft moves transversely to the central longitudinal axis and along the support rail, the carriage return apparatus comprising:

a primary carrier movably mounted on the shaft adjacent the first engagement plate and having stirring means mounted thereon directed downwardly into grain in the grain bin for stirring grain in a first zone, a drive bearing pivotally mounted on the primary carrier for frictionally engaging the shaft and moving the primary carrier longitudinally along the shaft, gear means pivotally attached to the primary carrier and secured to the drive bearing for pivoting the drive bearing, and a stop in connected to the gear means and pivotally mounted to and protruding from the primary carrier for striking the first engagement plate when the primary carrier reaches the first limit position;

a satellite carrier movably mounted on the shaft adjacent the second engagement plate and adjacent the primary carrier and having stirring means mounted thereon directed downwardly into grain in the grain bin for stirring grain in a second zone, means for engaging the shaft and supporting the satellite carrier for rolling movement longitudinally along the shaft, a stop pin pivotally mounted to and protruding from the satellite carrier for striking the second engagement plate when the satellite carrier reaches the second limit position; and a reversing rod assembly coupling the stop pin of the satellite carrier and the gear means of the primary carrier to pivot the drive bearing;

whereby the satellite carrier moves and changes direction in unison with the primary carrier such that both the primary carrier and the satellite carrier reciprocate longitudinally together along the shaft between the first and second limit position when the shaft is rotated.

2. The carriage return apparatus of claim 1 wherein the reversing rod assembly includes an adjustable length rod.

3. The carriage return apparatus of claim 2 wherein the adjustable length rod extends parallel to the longitudinal axis of the shaft.

4. The carriage return apparatus of claim 2 wherein the adjustable length rod includes a rigid rod threadingly connected with a hanger bolt having an eye at one end and threads at another end.

5. The carriage return apparatus of claim 2 wherein the adjustable length rod is set to a length less than one-half the length of the shaft between the engagement plates whereby the first zone and second zone overlap.

6. The carriage return apparatus of claim 1 wherein the reversing rod assembly comprises a rigid rod having opposite ends, one end being threadably connected to a hanger bolt having an eye and the other end being pivotally connected to a toggle bar fixed to the gear means of the primary carrier for pivoting therewith, and a toggle arm having a first end pivotally connected to the eye of the hanger bolt and a second end pivotally connected to a strap rigidly attached to the satellite carrier, the stop pin of the satellite carrier being rigidly attached to the second end of the toggle arm.

7. The carriage return apparatus of claim 1 comprising a fixed length tie bar rigidly interconnecting the primary carrier and the satellite carrier.

8. The carriage return apparatus of claim 1 comprising means fixed on the primary carrier for stopping pivotal movement of the gear means of the primary carrier.

9. The carriage return apparatus of claim 1 wherein the gear means of the primary carrier include a set of three adjacent and intermeshed gears pivotally mounted on the primary carrier, each of the gears having a respective axis of rotation extending vertically and teeth protruding horizontally, the set of gears comprising a central gear having a first drive bearing pivotally mounted thereon and opposite outer gears meshed with the central gear along a common axis parallel to the central longitudinal axis of the shaft, the outer gears have a toothless vertically disposed planar face opposite the central gear, the toothless face is perpendicular to a plane containing the common axis and the central longitudinal axis of the shaft.

10. The carriage return apparatus of claim 9 wherein an elongated toggle bar having opposite faces, opposite sides, and opposite ends has one of the opposite faces fixed to the planar face of the outer gear of the primary carrier proximate to the satellite carrier.

11. The carriage return apparatus of claim 10 comprising a elongated pivot arm having opposite faces, opposite sides, and opposite ends has one of the opposite faces fixed to the planar face of the outer gear of the primary carrier remote from the satellite carrier.

12. The carriage return apparatus of claim 11 comprising means for stopping pivotal movement of the gear means including an arm fixed to the primary carrier, an elongated stop rod having opposite ends extending through the arm and generally parallel to the longitudinal axis of the shaft between the toggle bar and the pivot arm, and a collar fixed against longitudinal movement on each of the ends of the stop rod, and a compression spring mounted on the stop rod and interposed between the arm and each respective collars.

13. The carriage return apparatus of claim 10 comprising a means for stopping pivotal movement of the gear means including a support member mounted on the primary carrier for supporting and journaling the drive bearing and the support member having an arm extending perpendicular to the central longitudinal axis of the shaft, and an elongated stop rod attached to the arm so as to extend parallel to the central longitudinal axis of the shaft and adjacent the toggle bar for stopping the pivotal movement of the toggle bar and the gear means.

14. The carriage return apparatus of claim 1 where in the grain bin has a circular cross-section and the support rail extends in a circle and is mounted in the grain bin.

15. An apparatus for stirring grain in a grain storage bin having a top portion, a bottom, and side walls, comprising:

a fixed length horizontal shaft having opposite ends movably mounted adjacent the top portion of said bin; at least two grain stirring devices movably mounted for longitudinal movement on said shaft;

a power mechanism for longitudinally moving said at least two grain stirring devices on said shaft and for reciprocally moving said at least two grain stirring devices in alternate longitudinal directions on said shaft; and an elongated link connecting said at least two stirring devices so that said at least two stirring devices move longitudinally in unison on said shaft, said link having a length less than one-half said length of said shaft so that the length of travel of each of said stirring devices overlaps to ensure thorough stirring along the complete length of said shaft;

said elongated link being adjustable in length.

* * * * *